US012559295B2

(12) United States Patent
Clark

(10) Patent No.: US 12,559,295 B2
(45) Date of Patent: Feb. 24, 2026

(54) POPCORN BAG FUNNEL ASSEMBLY

(71) Applicant: Jonathan Jo Clark, Wichita, KS (US)

(72) Inventor: Jonathan Jo Clark, Wichita, KS (US)

(73) Assignee: Jonathan Clark, Wichita, KS (US)

( * ) Notice: Subject to any disclaimer, the term of this patent is extended or adjusted under 35 U.S.C. 154(b) by 103 days.

(21) Appl. No.: 18/372,041

(22) Filed: Sep. 22, 2023

(65) Prior Publication Data

US 2024/0182223 A1 Jun. 6, 2024

Related U.S. Application Data

(60) Provisional application No. 63/409,481, filed on Sep. 23, 2022.

(51) Int. Cl.
*B65D 75/58* (2006.01)
*B65D 33/00* (2006.01)
*B65D 81/34* (2006.01)

(52) U.S. Cl.
CPC ..... *B65D 75/58* (2013.01); *B65D 33/00* (2013.01); *B65D 81/3469* (2013.01)

(58) Field of Classification Search
CPC ..... B65D 75/58; B65D 75/5861; B65D 75/5872; B65D 2581/3421
See application file for complete search history.

(56) References Cited

U.S. PATENT DOCUMENTS 3,072,277 A 1/1963 Hoffman
3,537,623 A 11/1970 Fisher
4,738,287 A 4/1988 Klinkel
5,078,872 A 1/1992 Durant et al.
5,107,666 A 4/1992 Ratican
5,551,606 A 9/1996 Rai et al.
5,609,194 A 3/1997 Link et al.
6,250,514 B1 6/2001 Hansson
6,264,072 B1 7/2001 Johannes
6,431,415 B1 * 8/2002 Schreiber ..... B65D 25/48 222/570
6,450,219 B1 9/2002 Ingram
2002/0145295 A1 10/2002 Frank et al.
2005/0139085 A1 6/2005 Clark
2008/0014314 A1 * 1/2008 Reynolds ..... B65D 25/48 426/107
2008/0045815 A1 * 2/2008 Derchak ..... A61B 5/0205 600/509

* cited by examiner

*Primary Examiner* — Jennifer C Chiang
(74) *Attorney, Agent, or Firm* — Robert O. Blinn

(57) ABSTRACT

A popcorn funnel assembly for directing popcorn from a popcorn bag includes an inlet end having an inlet opening that is arranged to fit a popcorn bag and an outlet end having an outlet opening suitable for conveying popped popcorn into the mouth of a person who is eating popcorn. The funnel assembly includes a funnel portion and a sleeve portion. The funnel portion includes a transversely oriented inwardly curved lower wall that is adjacent to the outlet end of the funnel portion and that presents a transversely arranged pattern of holes that are pear shaped with wider lower portions and that are of a suitable size for rejecting popped popcorn and for receiving un-popped kernels and directing them out of the funnel portion and into a receiving space for retaining kernels, the receiving space being enclosed by the inwardly curved wall of the funnel portion and the sleeve portion.

4 Claims, 9 Drawing Sheets

POPCORN BAG FUNNEL ASSEMBLY

CROSS REFERENCES TO RELATED APPLICATIONS

This application claims the benefit of U.S. Provisional Utility Patent Application No. 63/409,481 which was filed on 23 Sep. 2022, which is incorporated herein in its entirety.

FIELD

This invention relates to a popcorn bag funnel assembly for directing popped popcorn from inside a microwave popcorn bag into the mouth of a person eating popcorn.

BACKGROUND

Microwave popcorn usually comes in a standard sized bag that is placed in a microwave in an indicated position that is indicated on the bag with an indicia such as "THIS SIDE DOWN" and there is usually some indication that the consumer should unfold the package and lay it flat in the microwave oven. Typically, the bag is subjected to microwave radiation until most of the kernels in the bag have been popped at which point the bag expands and swells and may be opened to access the popped popcorn.

It is in the nature of popcorn that is being popped in this manner that the rate at which kernel popping occurs as a function of time in what is very likely a normal Gauss curve distribution or a "bell curve" distribution in which the height or Y value of the graph might correspond to the number of kernels that pop during a given interval of time with the time intervals being arranged along the X axis as a function of time. (See https://en.wikipedia.org/wiki/Normal_distribution). As those who are familiar with microwaving popcorn may attest, a few kernels pop early in the cycle, and, then, the sound of popping kernels accelerates until it reaches a rapid fire crescendo and then the sound diminishes until the sound of popping kernels becomes gradually less frequent and then sporadic. The applicant has observed that if a microwave popcorn bag is placed in a microwave oven and the microwave oven is allowed to run until there is no doubt that all of the kernels have been popped, it is often the case that a substantial portion of the popped kernels in the bag will be scorched. Accordingly, it is usually advantageous to stop the microwave process before all of the kernels are popped. This results in popped popcorn that is not scorched and this also usually results in a small number of kernels that have not been popped. If a funnel is being used to direct popped popcorn from the bag into the mouth of one who is eating popcorn, it is also important to prevent un-popped kernels from escaping through the funnel and into the mouth of the one who is eating popcorn.

SUMMARY

The above noted need is addressed by a popcorn bag funnel assembly that includes an inlet end and an outlet end and further includes a lower forward chamber that extends across the funnel that is bounded by an inwardly curved surface that presents a pattern of elongated pear shaped holes that are adapted for allowing the passage of un-popped popcorn kernels and for not allowing the passage of popped popcorn. The funnel assembly includes a funnel portion and a sleeve portion. The funnel portion presents an inlet end that defines an inlet opening that is shaped and sized to correspond to and be received by the open end of a popcorn bag containing mostly popped popcorn. The funnel portion is bounded by upper and lower walls and side walls. The upper, lower and side walls transition to front wall portions that blend toward discharge opening and a discharge chute that is opposite from the inlet opening and that is sized and shaped to be received by the mouth of one who is consuming popcorn. The forward extent of lower wall of the inside portion steps up to define an inwardly offset lower wall portion which is parallel to and offset from the lower wall portion toward the center line of the funnel portion by about 0.3 inches from the lower wall portion. The offset lower wall portion is connected to the lower wall portion by a curved wall portion that is transversely cylindrical in shape and has a radius of approximately 1 inch. The curved wall portion is tangent and continuous with the stepped-up lower wall portion at its far end but transitions and connects with the lower wall portion at its lower end preferably with a fillet. A series of openings is defined in this curved wall. These openings may be envisioned as being defined by arranging cylinders of approximately 0.3 inches in diameter which are evenly spaced approximately 0.6 inches center to center and arranged longitudinally, parallel to each other and horizontally and in contact or at least close proximity with the inside surface of the lower wall portion. It is further envisioned that the material of the curved wall that intersects with the cylinders is removed from the curved wall portion to define a pattern of evenly spaced elongated pear-shaped openings in the curved wall portion such that the wider portions of the pear-shaped openings are proximate to the lower wall portion and the narrow portions of the pear shaped openings are proximate to the offset lower wall portion.

The sleeve portion of the popcorn funnel assembly is arranged to fit around the outside of the mouth of the popcorn bag and includes a strap that is able to be secured around the bag and the funnel portion of the popcorn funnel assembly. The sleeve portion also has walls that are arranged to surround and enclose the inwardly curved wall that has the pattern of evenly spaced openings. This provides a receptacle for un-popped kernels that are captured by the openings in the inwardly curved wall.

DETAILED DESCRIPTION

Figure 1:
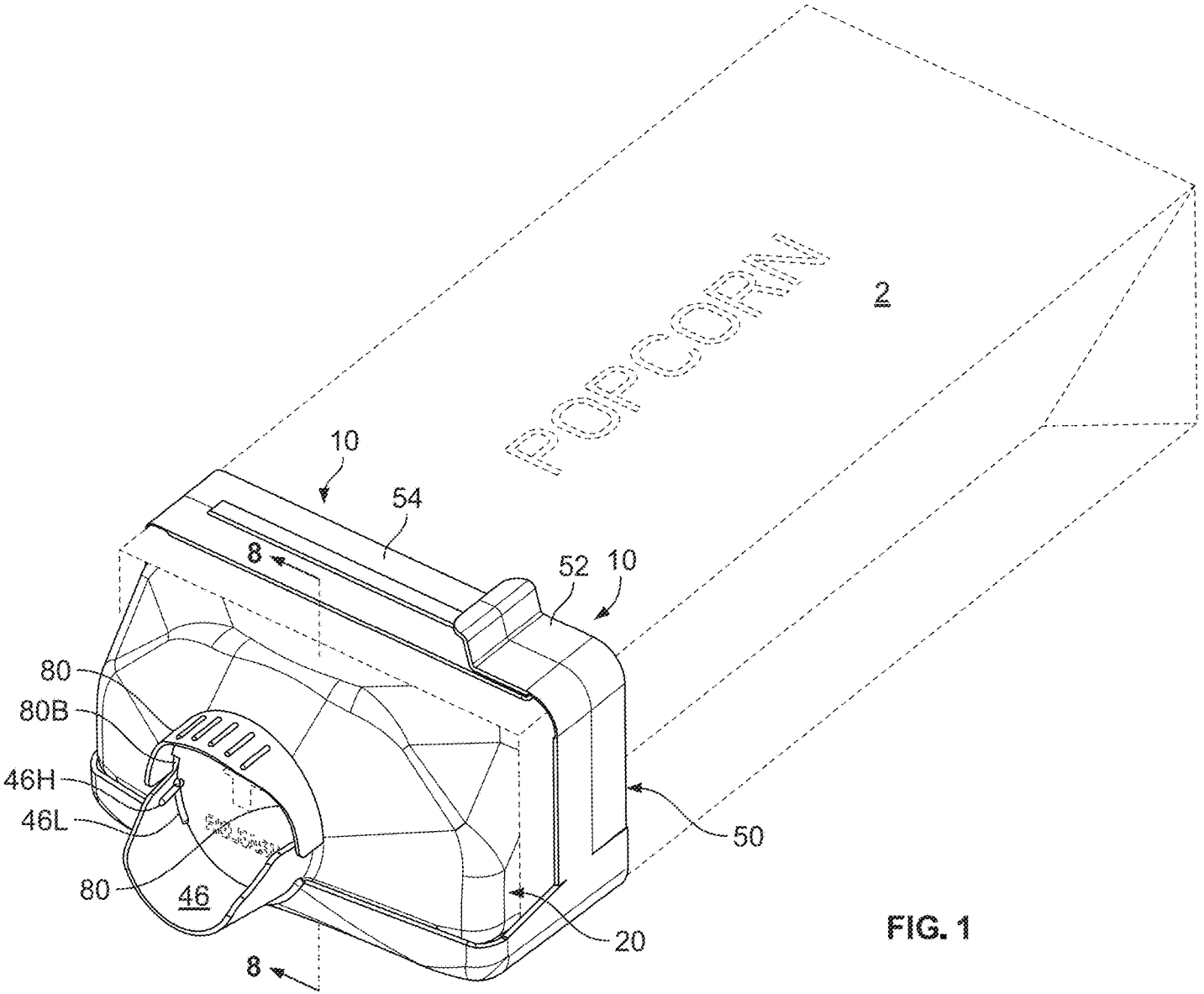
FIG. 1 is a perspective view of one embodiment of the popcorn bag funnel assembly.
Figure 2:
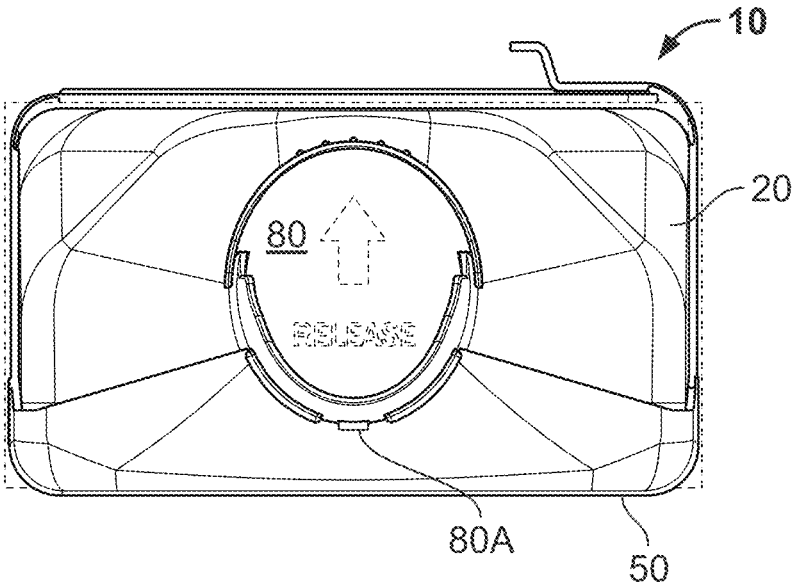
FIG. 2 is a front view of one embodiment of the popcorn bag funnel assembly.
Figure 3:
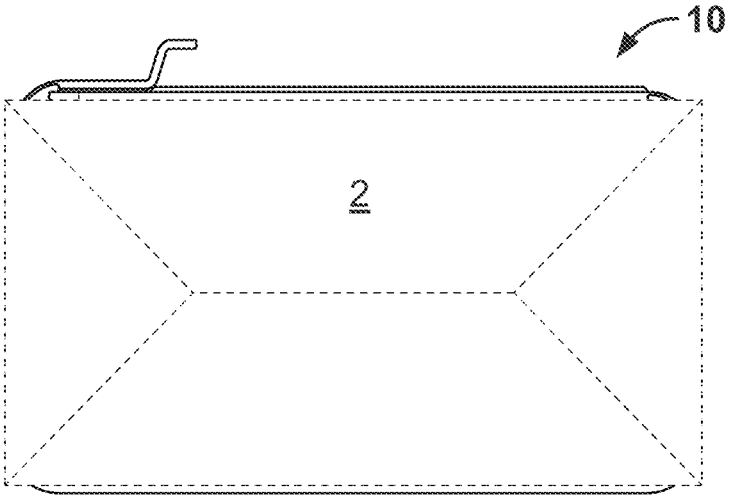
FIG. 3 is a rear view of one embodiment of the popcorn bag funnel assembly.
Figure 4:
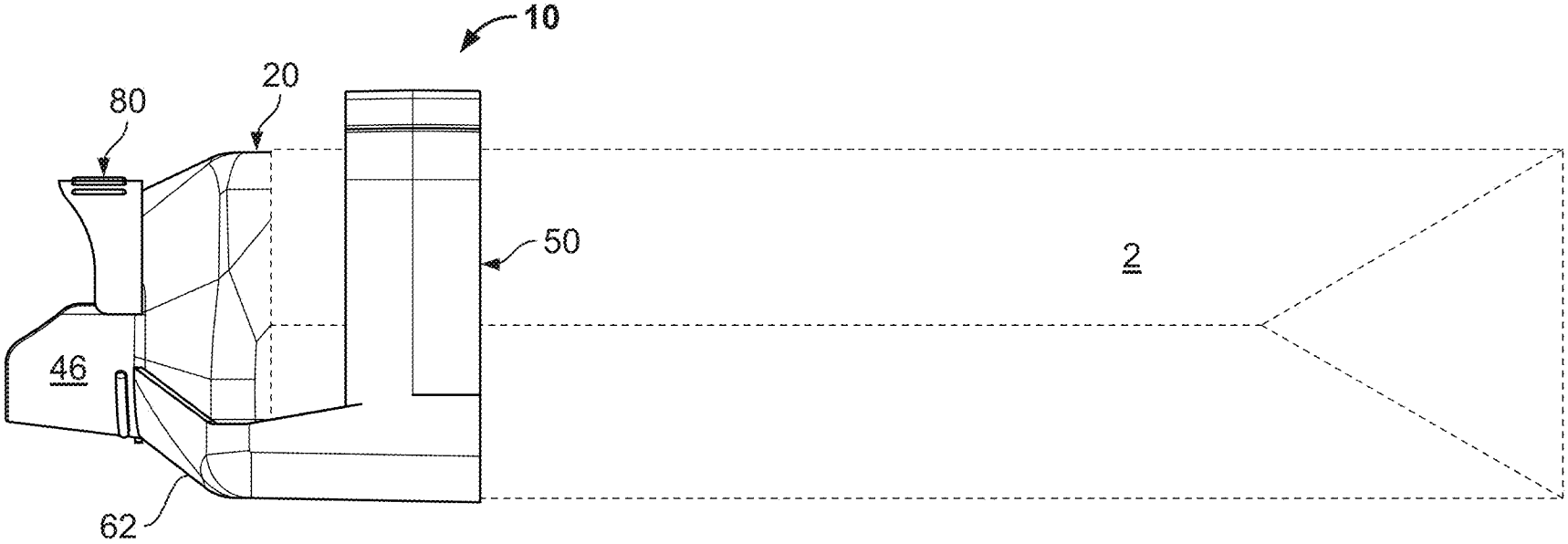
FIG. 4 is a side view of one embodiment of the popcorn bag funnel assembly.
Figure 5:
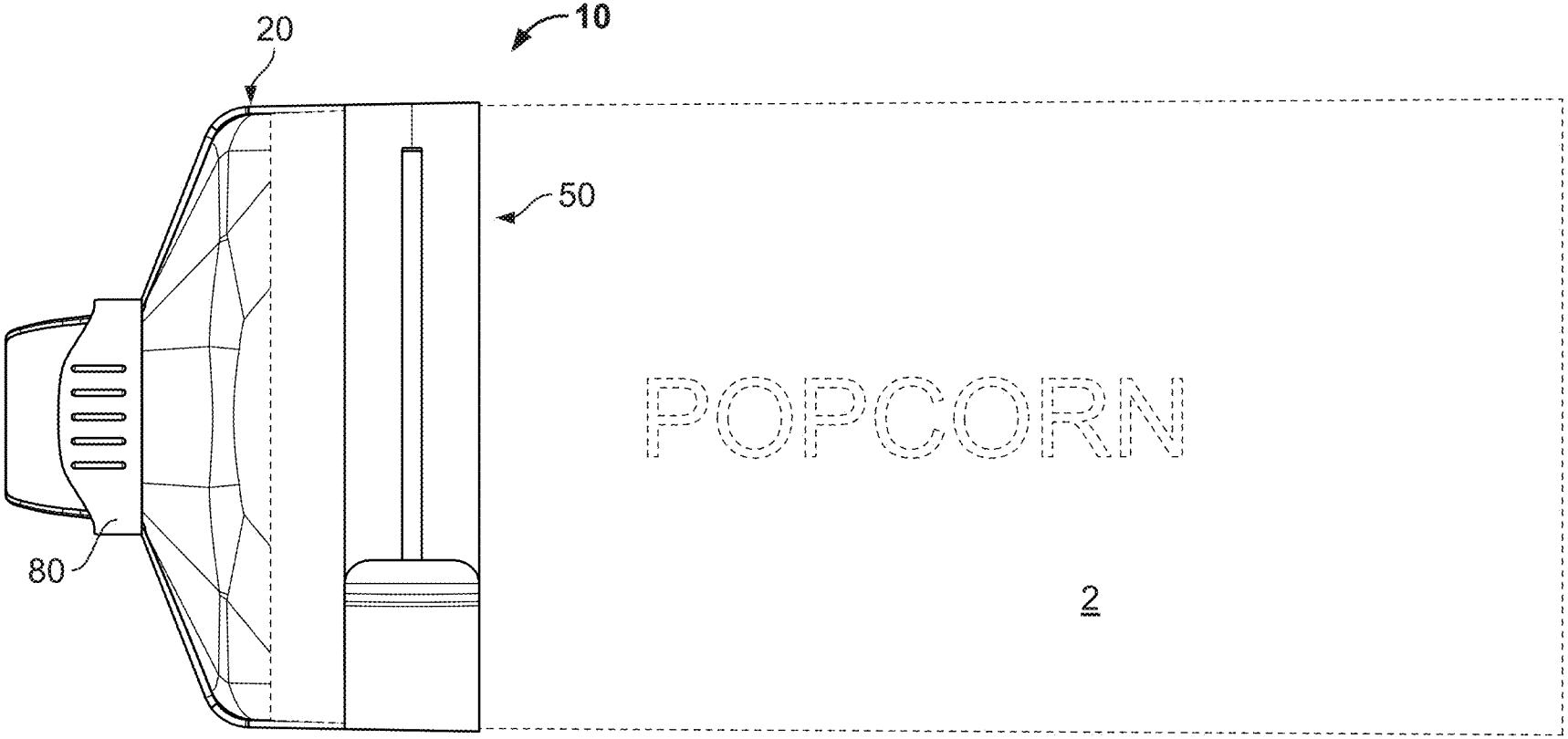
FIG. 5 is a top view of one embodiment of the popcorn bag funnel assembly.
Figure 6:
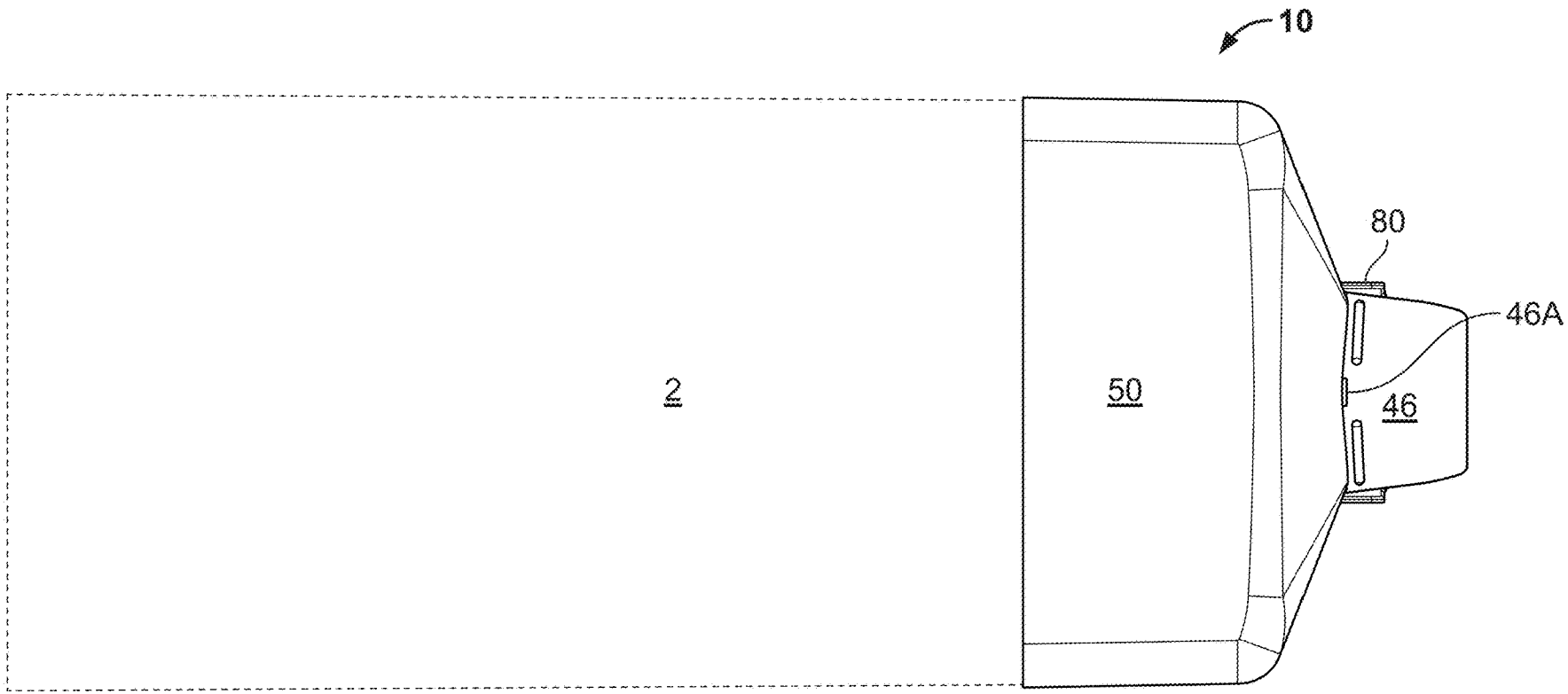
FIG. 6 is a bottom view of one embodiment of the popcorn bag funnel assembly.

Referring to FIG. 1, a popcorn bag funnel assembly 10 is shown, including a funnel portion 20, a sleeve portion 50 and a cap 80. Funnel portion 20 and sleeve portion 50 are adapted and arranged for use with a standard microwavable popcorn bag 2.

Figure 7:
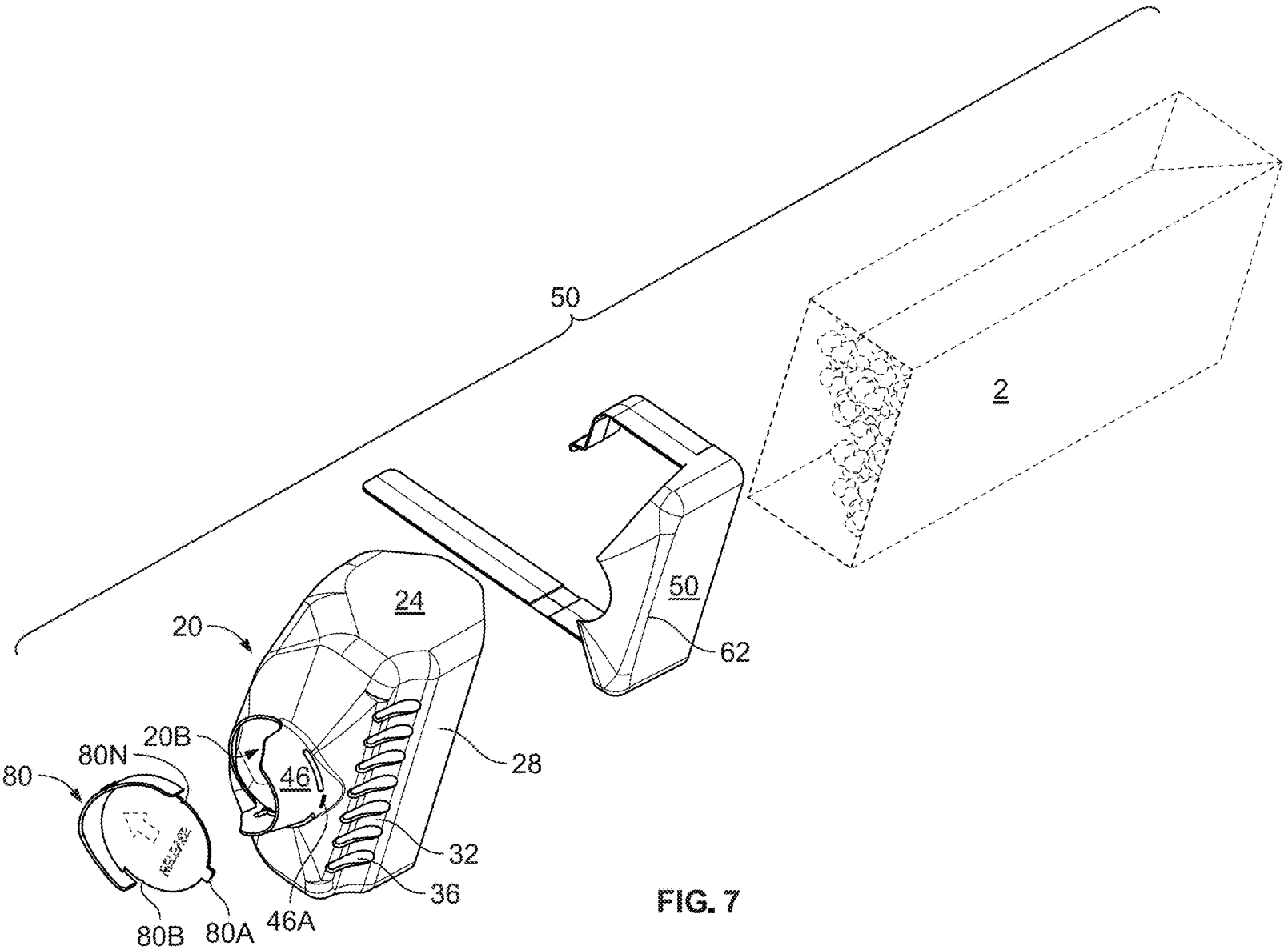
FIG. 7 is an exploded perspective view of one embodiment of the popcorn bag funnel assembly.

FIGS. 1 and 7 depicts the insertion of funnel portion 20 into the mouth of bag 2. Bag 2 has inside surfaces that come into contact with the outside surfaces of funnel portion 20. Sleeve portion 50 fits around the outside surfaces of bag 2 and funnel portion 20. Overlapping straps 52 and 54 preferably have corresponding Velcro® elements or similar interlocking corresponding textured surface pads of a type that is well known in the art and that are suitable for temporarily fastening the overlapping portions of straps 52 and 54. By way of further example, 3M Dual Lock™ segments may also be adhesively fixed to corresponding portions of straps 52 and 54 so that strap 52 is able to engage strap 54 in a securing by releasable manner.

Figure 8:
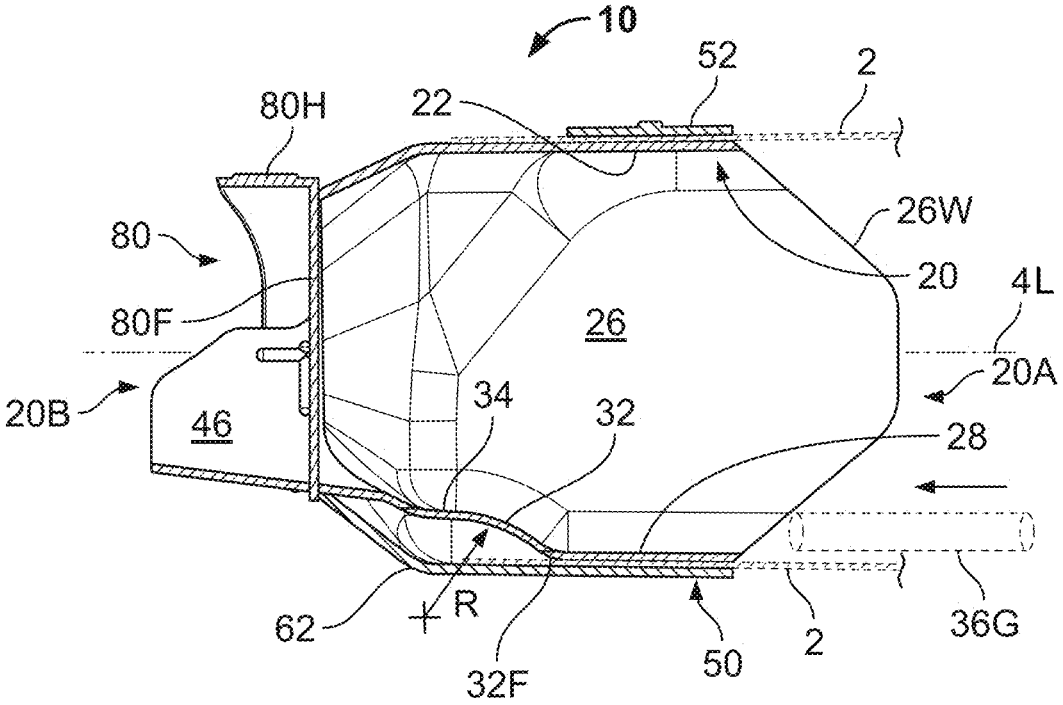
FIG. 8 is a cross section view of one embodiment of the popcorn bag funnel assembly taken from plane 8-8 indicated in FIG. 1.
Figure 9:
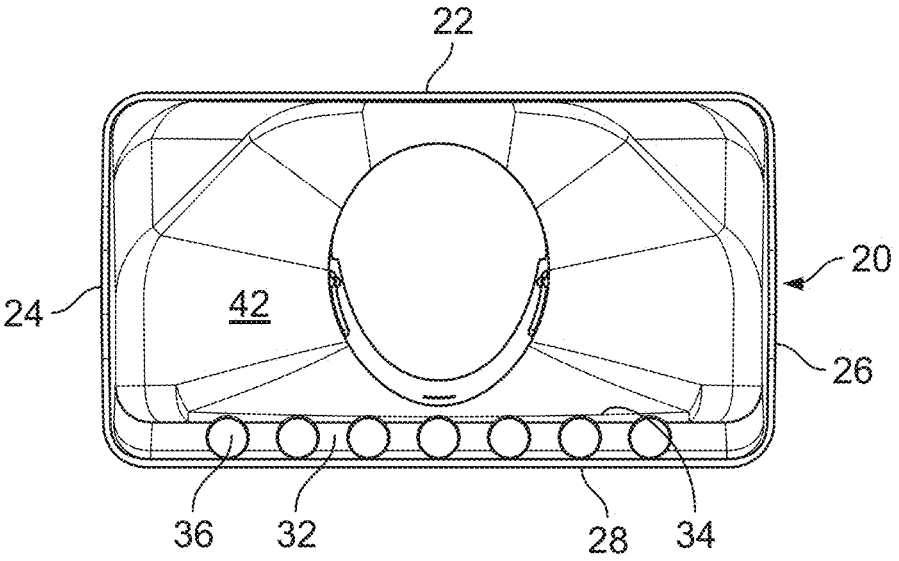
FIG. 9 is a second rear view of the funnel portion of the popcorn bag funnel assembly.
Figure 10:
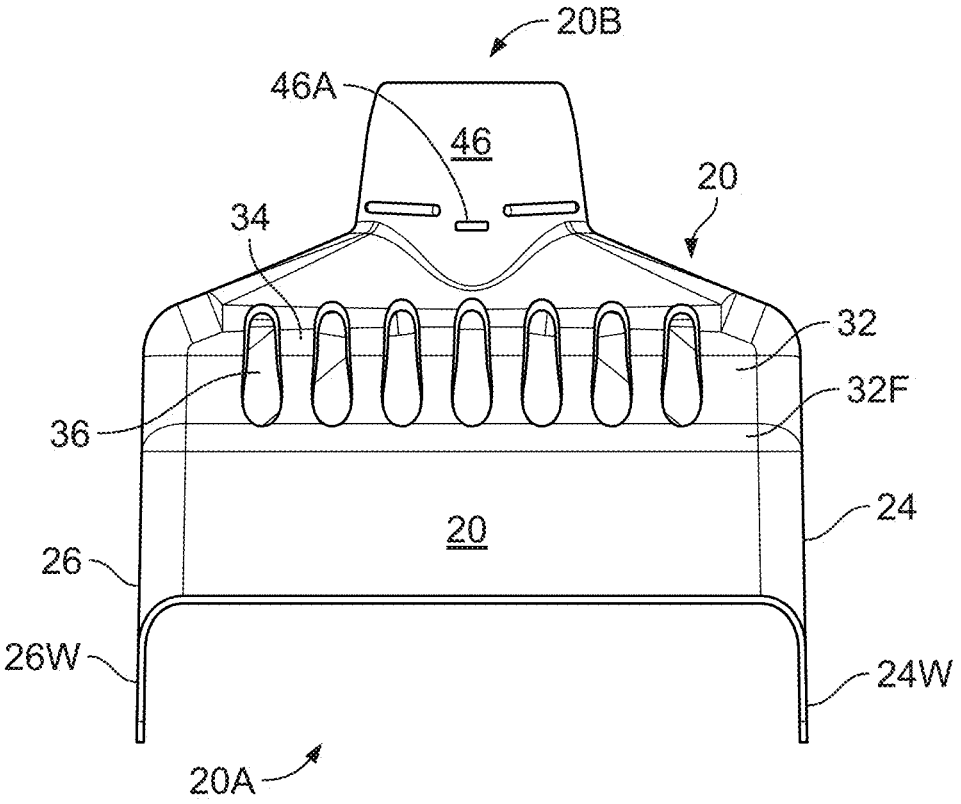
FIG. 10 is a bottom view of the funnel portion of the popcorn bag funnel assembly.
Figure 11:
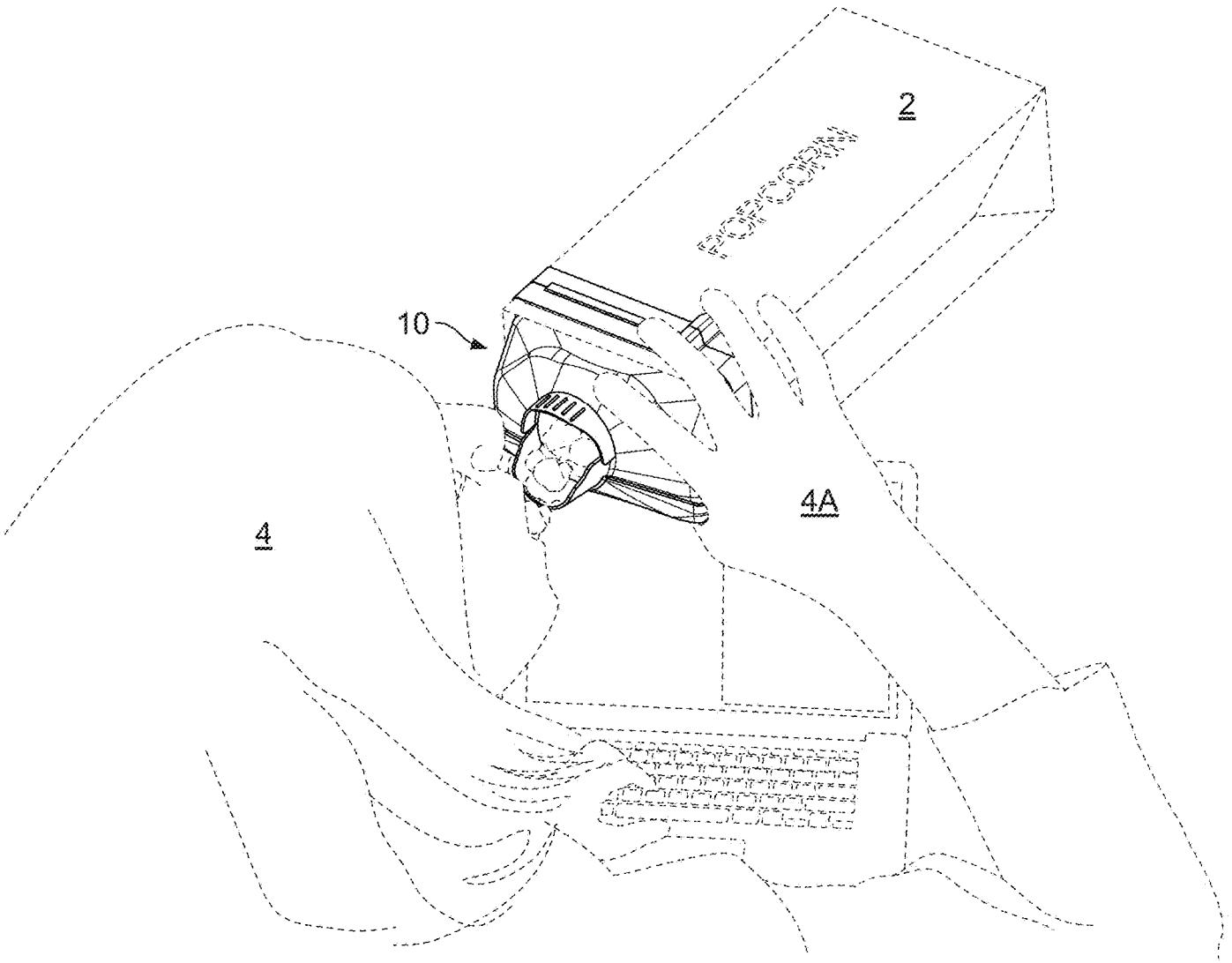
FIG. 11 is a perspective view of the popcorn funnel shown being used by a user 4 who is able to hold the popcorn funnel 2 with her hand 4A to consume popcorn.

FIGS. 7-10 depict funnel portion 20 and sleeve portion 50. As is shown in FIG. 10, funnel portion 20 extends from an inlet opening 20A to an outlet opening 20B. As can be seen in FIGS. 8 and 9, funnel portion 20 includes an upper wall 22, side walls 24 and 26 and a lower wall 28. Upper wall 22, side walls 24 and 26 and lower wall 28 are arranged in a rectangular shape at inlet end 20A. In this example side walls 24 and 26 present side wing portions 24A and 26A respectively to facilitate engaging the inside of popcorn bag 2. As can be seen in FIGS. 7-10, a converging portion 42 (indicated in FIG. 9) connects between walls 22, 24, 26 and 28 and outlet opening 20B (indicated in FIG. 10). Crucially, as shown in FIGS. 8 and 9, lower wall 28 transitions to an offset lower wall portion 34 by a curved wall segment 32 that connects between offset lower wall portion 34 and lower wall 28. Offset lower wall portion 34 is parallel to and vertically offset from lower wall 28 by approximately 0.3 inches. Curved wall segment 32 begins as extending tangent from offset lower wall portion 34 and curving down in a transversely oriented cylindrical fashion with a radius of curvature of approximately 1 inch until it connects with lower wall 28. In this example the transition between curved wall segment 32 and lower wall 28 is a fillet 32F which may have a radius of about 0.2 inches.

As can be best seen in FIGS. 8-10, a pattern of openings 36 is defined in curved wall segment 32. In this example, holes 36 are arranged between the left and the right sides and are evenly spaced. The definition of openings 36 may be envisioned by removing material as defined by cylinder 36G indicated in FIG. 8. Cylinder 36G may be envisioned as being arranged longitudinally in contact with the inside surface of lower wall 28 so that it is parallel to centerline 4L indicated in FIG. 8 and also extending forward to intersect with curved wall segment 32. By removing the material defined by the intersection of cylinder 36G and curved wall segment 32, an opening 36 is defined. This opening definition process is repeated in an evenly spaced manner to define openings 36 as shown in FIGS. 9 and 10. The skilled reader will note that the resulting openings appear circular in an end view as in FIG. 9, but are actually pear shaped having a wide portion at the lower extent of curved wall segment 32 adjacent to lower wall 28 and a relatively narrow portion near the upper extent of curved wall segment 32 adjacent to offset lower wall portion 34. The applicant has found that this particular shape for openings 36 is optimal for capturing and removing un-popped popcorn kernels.

As can be best seen in FIGS. 7 and 8, sleeve portion 50 serves a second function aside from securing funnel portion 20 to bag 2. Sleeve portion 50 includes a reservoir wall portion 62 (indicated in FIG. 8) that encloses the forward lower extent of funnel portion 20 that is adjacent to openings 36. Thus, reservoir wall portion 62 provides an enclosed volume that is suitable for receiving and retaining the un-popped popcorn kernels that will usually result from the popcorn popping process described above.

As can be best seen in FIGS. 1, 2, 4, 5 and 8, popcorn funnel assembly 10 includes a removable cap 80 that is able to provide a closure for funnel assembly 10. As can be seen in FIG. 1, the forward end of funnel portion 20 presents a spout 46 which is adapted to guide popcorn into a user's mouth. Cap 80 and spout 46 present a number of features which are adapted for enabling the retention of cap 80 in the closed position shown in FIG. 1 but also for enabling the easy removal of cap 80. Cap 80 includes a flat portion 80F (indicated in FIG. 8) that is shaped to correspond discharge opening 20B (indicated in FIG. 7). The upper extent of cap 80 presents a hood portion 80H (indicated in FIG. 8). The lower end of flat portion 80F presents a protruding tab 80A (indicated in FIG. 7) that is received by a corresponding slot 46A (indicated in FIGS. 6 and 7) that is defined in spout 46. The right and left ends of hood portion 80H and flat portion 80F are gapped to present slots 80B (indicated in FIG. 7) which are able to receive the right and left upper ends of spout 46. Spout 46 also has ridges 46L which further guide and retain flat portion 80F of cap 80. Spout 56 also presents longitudinal ridges 46H as shown in FIG. 1. Longitudinal ridges 46H are received by corresponding notches 80N (indicated in FIG. 7) in the periphery of flat portion 80F of cap 80 when cap 80 is installed as shown in FIGS. 1, 2, 4, 5, 6 and 8. Thus cap 80 and spout 46 are configured and arranged so that cap 80 can be installed as shown in FIGS. 1, 2, 4, 5, 6 and 8, but also removed when it is desired to pour popcorn from bag 2 through discharge opening 20B.

Many different arrangements of the various components depicted, as well as components not shown, are possible without departing from the scope of the claims below. Embodiments of the concept have been described with the intent to be illustrative rather than restrictive. Alternative embodiments will become apparent to readers of this disclosure after and because of reading it. Alternative means of implementing the aforementioned can be completed without departing from the scope of the claims below. Certain features and sub-combinations are of utility and may be employed without reference to other features and sub-combinations and are contemplated within the scope of the claims.

Having thus described the invention, what is claimed as new and desired to be secured by Letters Patent is:

1. A popcorn funnel assembly for directing popcorn from a microwave popcorn bag of the type of popcorn bags that are used for popping popcorn in microwave ovens, the popcorn funnel comprising:

a funnel portion and a sleeve portion, the funnel portion having an inlet end, the inlet end having an inlet opening that is arranged to fit a popcorn bag and an outlet end having an outlet opening that is reduce in size in relation to the size of the inlet opening, the outlet opening suitable for conveying popped popcorn into the mouth of a person eating popcorn, the funnel portion further including an inwardly curved wall that is adjacent to the outlet end and that presents a transversely arranged pattern of holes that are pear shaped with the wider portion oriented downwardly and that are sized for capturing un-popped kernels and directing them out of the funnel portion and into a space for retaining un-popped kernels, the space for retaining un-popped kernels being bounded by the inwardly curved wall of the funnel portion and at least one wall of the sleeve portion.

2. The popcorn funnel assembly of claim 1, wherein;

the funnel portion includes a generally rectangular portion that includes an upper wall, two side walls and a lower wall, the lower wall transitioning to an offset lower wall portion by a connecting curved wall segment that connects between the lower wall and the offset lower wall portion, the offset lower wall portion being parallel to and inwardly offset from the lower wall, the curved wall segment being a partial cylinder that extends in a tangential manner from the offset lower wall and connects with the lower wall, a series of evenly spaced holes being defined in the curved wall segment so as to appear circular when viewed longitudinally and pear shaped when viewed transversely, and wherein the sleeve portion encloses the funnel portion such that a void is defined between the curved wall segment of the funnel portion and the sleeve portion for capturing and holding un-popped popcorn kernels.

3. The funnel assembly of claim 2, wherein;

the offset between the lower wall and the offset lower wall is at least 0.3 inches.

4. The funnel assembly of claim 2, wherein;

the funnel assembly is arranged about a center axis, and the offset between the lower wall and the offset lower wall is at least 0.3 inches and wherein the holes of the pattern of holes in the curved wall segment are defined by removing material from the curved wall segment that would interfere with a cylinder that is parallel to the lower wall and between the lower wall and the offset lower wall and parallel to the center axis of the funnel assembly, the interfering cylinder for defining the holes of the pattern of holes having a diameter that is between 0.25 and 0.35 inches.

* * * * *